US005861370A

United States Patent [19]

Trinh et al.

[11] Patent Number: 5,861,370

[45] Date of Patent: Jan. 19, 1999

[54] CONCENTRATED, STABLE, PREMIX FOR FORMING FABRIC SOFTENING COMPOSITION

[75] Inventors: Toan Trinh, Maineville; George Joseph Harvey, Fairfield; Helen Bernardo Tordil, West Chester, all of Ohio; Hugo Jean Marie Demeyere, Merchtem; Marc Johan Declercq, Strombeek, both of Belgium; Errol Hoffman Wahl, Cincinnati, Ohio

[73] Assignee: The Procter & Gamble Company, Cincinnati, Ohio

[21] Appl. No.: 620,782

[22] Filed: Mar. 22, 1996

[51] Int. Cl.[6] ..... C11D 1/62; C11D 3/44; C11D 3/50

[52] U.S. Cl. ..... 510/504; 510/276; 510/329; 510/330; 510/515; 510/517; 510/521; 510/527; 510/522; 510/524; 510/525; 510/526

[58] Field of Search ..... 510/276, 329, 510/330, 504, 515, 517, 521, 527, 522, 524, 525, 526

[56] References Cited

U.S. PATENT DOCUMENTS

| | | | |
|---|---|---|---|
| 4,137,180 | 1/1979 | Naik et al. | 252/8.8 |
| 4,767,547 | 8/1988 | Straathoff et al. | 252/8.8 |
| 4,789,491 | 12/1988 | Chang et al. | 252/8.75 |
| 5,133,885 | 7/1992 | Contor et al. | 252/8.6 |
| 5,460,736 | 10/1995 | Trinh et al. | 252/8.8 |
| 5,545,340 | 8/1996 | Wahl et al. | 510/517 |

*Primary Examiner*—Douglas J. McGinty
*Assistant Examiner*—Charles Boyer
*Attorney, Agent, or Firm*—Robert B. Aylor

[57] ABSTRACT

Biodegradable fabric softener premix compositions are described containing (1) biodegradable softener actives that contain substantial unsaturation and (2) perfume. The premixes can be added at ambient temperatures to water containing acid, to provide a pH of from about 1.5 to about 5, to form finished compositions. The water can also contain calcium and/or magnesium salt to modify the viscosity.

9 Claims, No Drawings

CONCENTRATED, STABLE, PREMIX FOR FORMING FABRIC SOFTENING COMPOSITION

TECHNICAL FIELD

The present invention relates to concentrated liquid fabric softener actives and/or premixes for use in preparing softening compositions useful for softening cloth. It especially relates to the preparation of textile softening compositions for use in the rinse cycle of a home textile laundering operation to provide excellent fabric-softening/static-control benefits.

BACKGROUND OF THE INVENTION

Fabric softening compositions containing high solvent levels are known in the art. However, there is a need for highly concentrated "compositions" that are, in effect, premixes, that can be used to form finished compositions that are suitable for sale to consumers, said highly concentrated compositions having a viscosity that allows them to be stored, pumped, and processed at ambient temperatures into finished aqueous compositions without the need for high shear mixing. This is of particular importance when one wants to provide the fabric softening benefit to consumers in remote areas of the world, where the cost of transporting finished product to the area from some other location is prohibitively expensive and the local manufacturing facilities are limited and rudimentary.

The present invention provides highly concentrated compositions containing biodegradable actives with either no, or relatively low, organic solvent level (i.e., below about 40%, by weight of the composition), that have improved stability (i.e., do not precipitate, gel, thicken, or solidify) at normal, i.e., room temperatures and sub-normal temperatures under prolonged storage conditions, that can be processed at room temperatures, and that will disperse in water, preferably without high shear mixing, to form stable compositions.

SUMMARY OF THE INVENTION

The high active fabric softener "premix" compositions, useful for preparing finished compositions, herein comprise:

A. from about 50% to about 85%, preferably from about 60% to about 80%, more preferably from about 65% to about 75%, by weight of the composition, of biodegradable fabric softener active selected from the group consisting of:

1. softener having the formula:

$$[(R)_{4-m}—N^{(+)}—[(CH_2)_n—Y—R^1]_m]X^{(-)} \quad (1)$$

wherein each R substituent is a short chain $C_1$–$C_6$, preferably $C_1$–$C_3$ alkyl or hydroxyaluyl group, e.g., methyl (most preferred), ethyl, propyl, hydroxyethyl, and the like, benzyl, or mixtures thereof; each m is 2 or 3; each n is from 1 to about 4; each Y is —O—(O)C—, or —C(O)—O—; the sum of carbons in each $R^1$, plus one when Y is —O—(O)C—, is $C_6$–$C_{22}$, preferably $C_{14}$–$C_{20}$, and when one $YR^1$ sum is from about 6 to about 10, the other $YR^1$ sum is from about 16 to about 22, with each $R^1$ being hydrocarbyl, or substituted hydrocarbyl, substituent, preferably alkyl or alkylene; and where the total average Iodine Value (hereinafter referred to as IV) of the parent fatty acid of this $R^1$ group is preferably from about 60 to about 140, more preferably from about 70 to about 130; and most preferably from about 80 to about 115 (As used herein, the Iodine Value of a "parent" fatty acid, or "corresponding" fatty acid, is used to define an average level of unsaturation for all of the $R^1$ groups that are present, that is the same as the level of unsaturation that would be present in fatty acids containing the same $R^1$ groups); and wherein the counterion, $X^-$, can be any softener-compatible anion, preferably, chloride, bromide, or nitrate, more preferably chloride;

2. softener having the formula:

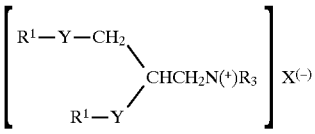

(2)

wherein each Y, R, $R^1$, and $X^{(-)}$ have the same meanings as before (Such compounds include those having the formula:

$$[CH_3]_3N^{(+)}[CH_2CH(CH_2OC[O]R^1)OC(O)R^1]Cl^{(-)}$$

where $C(O)R^1$ is derived from unsaturated, e.g., natural source fatty acid high in oleic fatty acid, and, preferably, each R is a methyl or ethyl group and preferably each $R^1$ is in the range of $C_{15}$ to $C_{19}$ with degrees of branching and substitution optionally being present in the alkyl chains); and 3. mixtures thereof;

B. perfume at an effective level, e.g., to provide the desired perfume effect in the finished composition and to improve processability of the premix, but less than about 50%, preferably less than about 15%, and more preferably less than about 10%;

C. optionally, from 0% to about 20%, preferably from about 5% to about 15%, by weight of the premix composition, of low molecular weight alcohol to lower the viscosity of the mixture of A. and B. if needed;

D. optionally, less than about 40%, preferably from about 10% to about 30%, more preferably from about 13% to about 25%, even more preferably from about 15% to about 20% by weight of the premix composition of water soluble organic solvent other than said low molecular weight alcohol C., having a boiling point above about 85° C., more preferably above about 100° C., if the addition of C. at the indicated levels is not sufficient to reach the desired viscosity; and E. optionally, from 0% to about 35%, preferably from about 3% to about 25%, and more preferably from about 6% to about 15%, of a dispersibility aid; and the premix composition being pumpable, preferably pourable, and, more preferably, the viscosity of the premix composition being less than about 1000 cps, preferably less than about 500 cps, more preferably less than about 300 cps.

DETAILED DESCRIPTION OF THE INVENTION

A. FABRIC SOFTENING ACTIVE

The premixes herein contain, as an essential component, from about 50% to about 85%, preferably from about 60% to about 80%, more preferably from about 65% to about 75%, by weight of the composition, of a fabric softener active selected from the compounds identified hereinafter, and mixtures thereof.

Diester Quaternary Ammonium Fabric Softening Active Compound (DEQA)

(1) The first type of DEQA preferably comprises, as the principal active, compounds of the formula $$[(R)_{4-m}—N^{(+)}—[(CH_2)_n—Y—R^1]_m]X^{(-)} \quad (1)$$

wherein each R substituent is a short chain $C_1$–$C_6$, preferably $C_{1-C3}$ alkyl or hydroxyalkyl group, e.g., methyl (most preferred), ethyl, propyl, hydroxyethyl, and the like, benzyl or mixtures thereof, each m is 2 or 3; each n is from 1 to about 4; each Y is —O—(O)C—, or —C(O)—O—; the sum of carbons in each $R^1$, plus one when Y is —O—(O)C—, is $C_{12}$–$C_{22}$, preferably $C_{14}$–$C_{20}$, with each $R^1$ being a hydrocarbyl, or substituted hydrocarbyl, group, preferably allyl or alkylene (mono- and/or poly-unsaturated), either straight and/or branched, and especially mixtures of groups derived from natural sources. Preferred compounds contain different $R^1$ groups. The average Iodine Value (hereinafter referred to as IV) of the parent fatty acid of this $R^1$ group is preferably from about 60 to about 140, more preferably from about 70 to about 130; and most preferably from about 80 to about 115.

The counterion, $X^{(-)}$ above, can be any softener-compatible anion, preferably the anion of a strong acid, for example, chloride, bromide, methylsulfate, sulfate, nitrate and the like, and more preferably chloride.

These biodegradable quaternary ammonium fabric softening compounds can contain the group $C(O)R^1$ which is derived, primarily from unsaturated fatty acids, e.g., oleic acid, and/or fatty acids, and/or partially hydrogenated fatty acids, which are derived from vegetable oils, and/or partially hydrogenated vegetable oils, such as, canola oil, safflower oil, peanut oil, sunflower oil, corn oil, soybean oil, tall oil, rice bran oil, etc. Non-limiting examples of DEQAs prepared from preferred fatty acids have the following approximate distributions:

| Fatty Acyl Group | DEQA[1] | DEQA[2] | DEQA[3] | DEQA[4] | DEQA[5] |
|---|---|---|---|---|---|
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | 0 |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |
| Unknowns | 0 | 0 | 6 | 6 | 7 |
| Total | 99 | 99 | 100 | 100 | 102 |
| IV | 86–90 | 88–95 | 99 | 100 | 95 |
| cis/trans (C18:1) | 20–30 | 20–30 | 4 | 5 | 5 |
| TPU | 4 | 9 | 10 | 13 | 13 |

Nonlimiting examples of DEQA's that can be blended, to form DEQA's of this invention are as follows:

| Fatty Acyl Group | DEQA[10] | DEQA[11] |
|---|---|---|
| C14 | 0 | 1 |
| C16 | 11 | 25 |
| C18 | 4 | 20 |
| C14:1 | 0 | 0 |
| C16:1 | 1 | 0 |
| C18:1 | 27 | 45 |
| C18:2 | 50 | 6 |
| C18:3 | 7 | 0 |
| Unknowns | 0 | 3 |
| Total | 100 | 100 |
| IV | 125–138 | 56 |
| cis/trans (C18:1) | Not Available | 7 |

-continued

| Fatty Acyl Group | DEQA[10] | DEQA[11] |
|---|---|---|
| TPU | 57 | 6 |

DEQA[10] is prepared from a soy bean fatty acid, and DEQA[11] is prepared from a slightly hydrogenated tallow fatty acid.

| Fatty Acyl Group | DEQA[12] | DEQA[13] | DEQA[14] |
|---|---|---|---|
| Isomyristic acid | — | 1–2 | — |
| Myrisitic acid | 7–11 | 0.5–1 | — |
| Isopalmitic acid | 6–7 | 6–7 | 1–3 |
| Palmitic acid | 4–5 | 6–7 | — |
| Isotearic acid | 70–76 | 80–82 | 60–66 |
| Stearic acid | — | 2–3 | 8–10 |
| Isoleic acid | — | — | 13–17 |
| Oleic acid | — | — | 6–12 |
| IV | 3 | 2 | 7–12 |

DEQA[12]–DEQA[14] are prepared from different commercially available isostearic acids.

The more preferred DEQA's are those that are prepared as a single DEQA from blends of all the different fatty acids that are represented (total fatty acid blend), rather than from blends of mixtures of separate finished DEQA's that are prepared from different portions of the total fatty acid blend.

The unsaturated, including the essential polyunsaturated, fatty acyl groups surprisingly provide effective softening, but also provide better rewetting characteristics, good antistatic characteristics, and especially, due to the polyunsaturated fatty acids, superior recovery after freezing and thawing.

The preferred highly unsaturated materials are also easier to formulate into concentrated premixes that maintain their low viscosity and are therefore easier to process, e.g., pump, mixing, etc. These highly unsaturated materials with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it mimimizes degradation. Additional protection against degradation can be provided when the compounds and softener compositions contain effective antioxidants and/or reducing agents, as disclosed hereinafter.

It will be understood that substituents R and $R^1$ can optionally be substituted with various groups such as alkoxyl or hydroxyl groups, and can be straight, or branched so long as the $R^1$ groups maintain their basically hydrophobic character. Branched chains can be highly desirable, especially in mixtures of fatty acids, to lower the viscosity while still providing good stability. The preferred compounds can be considered to be biodegradable diester variations of ditallow dimethyl ammonium chloride (hereinafter referred to as "DTDMAC"), which is a widely used fabric softener. A preferred long chain DEQA is the DEQA prepared from sources containing high levels of polyunsaturation, i.e., N,N-di(acyl-oxyethyl)-N,N-dimethyl ammonium chloride, where the acyl is derived from fatty acids containing sufficient polyunsaturation, e.g., mixtures of tallow fatty acids and soybean fatty acids.

It is preferred that most of the fatty acyl groups are unsaturated, e.g., from about 50% to 100%, preferably from about 60% to about 98%, more preferably from about 65% to about 95%, and that the total level of polyunsaturated fatty acyl groups (TPU) be from about 1% to about 30%, preferably from about 3% to about 25%, more preferably from about 5% to about 18%, and even more preferably more than about 10%. The cis/trans ratio for the unsaturated fatty acyl groups is important, with the cis/trans ratio being from 1:1 to about 50:1, the minimum being 1:1, preferably at least 3:1, and more preferably from about 4:1 to about 30:1.

These biodegradable fabric softener actives typically contain a certain percentage, preferably low, e.g., less than about 5%, of free fatty acid. The free fatty acid also acts as a viscosity modifier, as disclosed hereinafter and can add some softening benefit.

These premixes are also easy to formulate into lower concentration (from about 2% to about 40%, preferably from about 3% to about 30%, more preferably from about 4% to about 28%, by weight of the composition), stable compositions at ambient temperatures and/or without the use of high shear mixing, i.e., simple mixing is sufficient. It is understood, however, that high shear mixing and/or high temperatures can be used, if desired.

The preferred compounds can be considered to be biodegradable diester variations of ditallow dimethyl ammonium chloride (hereinafter referred to as "DTDMAC"), which is a widely used fabric softener. Preferably, at least about 80% of the DEQA is in the diester form, and from 0% to about 20% can be DEQA monoester (e.g., in formula (1), m is 2 and $YR^1$ is either H or a —C(O)OH group). A highly preferred long chain DEQA is one containing a relatively high level of dioleyl DEQA, i.e., N,N-di(oleoyl-oxyethyl)-N,N-dimethyl ammonium chloride. Preferred sources of fatty acids for use in preparing the DEQAs herein are the triglycerides, and/or partially hydrogenated triglycerides, from plants such as soybean oil, canola oil, safflower oil, peanut oil, sunflower oil, corn oil, soybean oil, tall oil, rice bran oil, etc. It is highly desirable that the compounds used herein are relatively free from unwanted impurities. Therefore, it is desirable to process the fatty acid sources in ways that are known to eliminate such impurities, e.g., processing under atmospheres that are low in oxygen, separating unwanted materials by filtration, adsorption, etc., either before and/or after chemical modification by controlled hydrogenation and/or oxygenation, etc. However, the purity of the materials is not part of the invention herein, which is equally applicable to less pure materials, the trade-off between purity and cost always being adjusted in light of the comsumer's desires and needs.

As used herein, when the diester is specified, it can include the monoester that is present. For softening, under no/low detergent carry-over laundry conditions the percentage of monoester should be as low as possible, preferably no more than about 5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the DEQA.

The above compounds, used as the biodegradable quaternized ester-amine softening material in the practice of this invention, can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^1C(O)Cl$, then quaternized with an alkyl halide, RX, to yield the desired reaction product (wherein R and $R^1$ are as defined hereinbefore). however, it will be appreciated by those skilled in the chemical arts that this reaction sequence allows a broad selection of agents to be prepared.

Yet another DEQA softener active that is suitable for the formulation of the highly concentrated, liquid fabric softener premixes of the present invention, has the above formula (1) wherein one R group is a $C_{1-4}$ hydroxyalkyl group, preferably one wherein one R group is a hydroxyethyl group. An example of such a hydroxyethyl ester active is di(acyloxyethyl)(2-hydroxyethyl)methyl ammonium methyl sulfate, where the acyl group is the same as that of $DEQA^1$, and is denoted hereinafter as $DEQA^8$.

(2) The second type of DEQA active has the general formula:

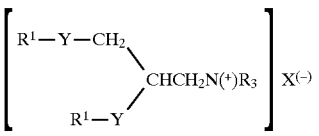

(2)

wherein each Y, R, $R^1$, and $X^{(-)}$ have the same meanings as before. Such compounds include those having the formula:

$$[CH_3]_3N^{(+)}[CH_2CH(CH_2OC[O]R^1)OC(O)R^1]Cl^{(-)}$$

where each R is a methyl or ethyl group and preferably each $R^1$ is in the range of $C_{15}$ to $C_{19}$. Degrees of branching and substitution can be present in the alkyl and/or alkylene chains. As used herein, when the diester is specified, it can include the monoester that is present. The amount of monoester that can be present is the same as in DEQA (1). An example of a preferred DEQA of formula (2) is the "propyl" ester quaternary ammonium compound having the formula 1,2-di(acyloxy)-3-trimethylammonium chloride, where the acyl group is the same as that for $DEQA^5$, and is denoted hereinafter as $DEQA^9$.

These types of agents and general methods of making them are disclosed in U.S. Pat. No. 4,137,180, Naik et al., issued Jan. 30, 1979, which is incorporated herein by reference.

In preferred softener actives (1) and (2), each $R^1$ is a hydrocarbyl, or substituted hydrocarbyl, group, preferably, alkyl, monounsaturated alkylene, and polyunsaturated alkylene groups, with the softener active containing polyunsaturated alkylene groups being at least about 3%, preferably at least about 5%, more preferably at least about 10%, and even more preferably at least about 15%, by weight of the total softener active present (As used herein, the "percent of softener active" containing a given $R^1$ group is the same as the percentage of that same $R^1$ group is to the total $R^1$ groups used to form all of the softener actives.); the actives preferably containing mixtures of $R^1$ groups, especially within the individual molecules, and also, optionally, but preferably, the saturated $R^1$ groups comprising branched chains, e.g., from isostearic acid, for at least part of the saturated $R^1$ groups, the total of active represented by the branched chain groups preferably being from about 1% to about 90%, preferably from about 10% to about 70%, more preferably from about 20% to about 50%, (As used herein, the Iodine Value of a "parent" fatty acid, or "corresponding" fatty acid, is used to define a level of unsaturation for an $R^1$ group that is the same as the level of unsaturation that would be present in a fatty acid containing the same $R^1$ group.).

Compositions that can be prepared, include those described in the copending application of Errol H. Wahl et al. Ser. No. 08/461,207, filed Jun. 5, 1995 for "Concentrated Biodegradable Quaternary Ammonium Fabric Softener Compositions and Compounds Containining Intermediate Iodine Value Unsaturated Fatty Acid Chains," said application being incorporated herein by reference.

The DEQA actives described hereinbefore can contain a low level of free fatty acid which can be unreacted starting material and/or the by-product of a partial degradation (hydrolysis) of the softener active. It is preferred that the level of free fatty acid be low, preferably below about 10%, and more preferably below about 5%, by weight of the softener active.

D. PERFUME

It has been discovered, that when the above, highly unsaturated, biodegradable softening actives, are combined with perfume, the resulting "premix" can be pumped, poured, and/or processed, at ambient temperatures. The premixes and finished compositions of the present invention can contain any softener compatible perfume at a level that will provide the desired perfume effect in the final, finished product and lower the viscosity of the premix, thus improving processability. The level of the perfume is typically below about 25%, preferably from about 0.5% to about 15%, more preferably from about 1% to about 10% to allow for dilution during the making of the final composition. It is an advantage of the use of this invention, that the perfume, as well as the other optional solvents, and/or other ingredients, can be added in the premix to simplify the preparation of the finished compositions, while, at the same time, the processability of the active is improved.

This convenient premix is not possible with conventional actives. In conventional liquid fabric softener compositions, the softener actives are derived from fatty acids with low IV values (less than about 60) and need to be heated and melted before they can be dispersed in water. Perfumes should not be exposed to the temperatures required for this melting. Some perfume ingredients are degraded and some are volatilized and lost.

The premixes of the present invention, which contain perfume, can be added to water, desirably containing the requisite amount of acid, preferably mineral acid, more preferably HCl, at an ambient temperature, to create the finished composition as discussed hereinafter. Use of the premixes herein provides additional protection for materials that can be degraded and avoids the use of high energy levels, thus lowering the total environmental load that is created in the manufacture of the finished compositions.

C. LOW MOLECULAR WEIGHT ALCOHOLS

Low molecular weight alcohols can also be used at levels of from 0% to about 20%, preferably from about 1% to about 10%, more preferably from about 2% to about 8%, by weight of the premix composition. These low molecular weight alcohols are normally inexpensive, usually come with the softener active, and lower the viscosity. When the perfume does not provide sufficiently low viscosity, these solvents will normally be sufficient to provide the needed viscosity.

The level of such low molecular weight alcohols should be kept low for odor, safety, and environmental reasons. For example, isopropyl alcohol and n-propyl alcohols have distinct odors and can create a fire hazard if used at high levels. However, these solvents can be part of the total solvent present. Several butyl alcohols also have odors but can be used for effective viscosity/stability, especially when used at low levels to minimize their odor. Such low molecular weight alcohols include: ethanol; isopropanol; n-propanol; etc. If the low molecular weight alcohols are insufficient, then one can add solvent D., as disclosed below.

D. WATER SOLUBLE ORGANIC SOLVENT

The premix compositions of the present invention can optionally comprise less than about 40%, e.g., from about 10% to about 30%, preferably from about 13% to about 25%, more preferably from about 15% to about 20%, by weight of the premix composition of water soluble organic solvent having a boiling point above about 85° C., more preferably above about 100° C. Preferably the flash point of the solvent should be higher than ambient temperatures, e.g., more than about 25° C., and desirably more than about 35° C., for safety reasons. These water soluble organic solvents are preferably totally miscible with water.

Non-limiting examples of the water soluble organic solvent includes diols (Especially those described in the copending applications filed concurrently herewith having Ser. Nos. 08/620,515 ; filed Mar. 22, 1996; 08/620,755 filed Mar. 22, 1996 and 08/621,019 filed Mar. 22, 1996), propylene carbonate, and low molecular weight polyethylene glycols, although the polyethylene glycols are not preferred, and in some instances should be excluded to avoid problems in the finished compositions, e.g., clear compositions as disclosed in said copending application, Ser. No. 08/621,019 filed Mar. 22, 1996.

Said water soluble organic solvent, when present, is selected to provide the desired viscosity to the premix that will allow it to be processed at normal ambient temperatures. The low viscosity and the ability to create finished compositions with only conventional mixing is possible with the highly unsaturated fabric softener compounds disclosed hereinbefore. If the perfume and alcohols C. are insufficient to provide acceptable low viscosities for the premix, i.e., viscosities of from less than about 1000 cps, preferably less than about 500 cps, more preferably less than about 300 cps, at temperatures down to about 10° C., preferably down to about 20° C., then solvent D. can be used to provide any needed viscosity reduction, and/or other desired properties, e.g., product clarity.

E. DISPERSIBILITY AIDS

The premix of the present invention can optionally contain dispersibility aids, e.g., those selected from the group consisting of mono-long chain alkyl cationic quaternary ammonium compounds, mono-long chain alkyl amine oxides, other nonionic surfactants, and mixtures thereof, to assist in the formation of the finished compositions. These dispersibility aids are especially useful in the preparation of dilute softener compositions containing relatively high levels of perfume, as discussed hereinafter. When said dispersibility aid is present , it is typically present at a total level of from about 2% to about 35%, preferably from about 3% to about 25%, more preferably from about 4% to about 15%, and even more preferably from 5% to about 13% by weight of the composition. These materials can either be added as part of the active softener raw material, (I), or added as a separate component in the preparation of the finished softener compositions. The total level of dispersibility aid includes any amount that may be present as part of component (I).

(1) Mono-Alkyl Cationic Quaternary Ammonium Compound

When the mono-alkyl cationic quaternary ammonium compound is present, it is typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

Such mono-alkyl cationic quaternary ammonium compounds useful in the present invention are, preferably, quaternary ammonium salts of the general formula:

$$[R^4N^+(R^5)_3]X^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group;

each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $X^-$ is as defined hereinbefore for (Formula (I)).

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups which can be desirable for increased concentratability of component (1), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$R^1(C(O)—O—CH_2CH_2N^+(R)_3X^-$$

wherein $R^1$, R and $X^-$ are as defined previously.

Highly preferred dispersibility aids include $C_{12}$–$C_{14}$ coco choline ester and $C_{16}$–$C_{18}$ tallow choline ester.

Suitable biodegradable single-long-chain alkyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis (polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

Although the main function of the dispersibility aid is to increase the dispersibility of the ester softener, preferably the dispersibility aids of the present invention also have some softening properties to boost softening performance of the composition. Therefore, preferably the compositions of the present invention are essentially free of non-nitrogenous ethoxylated nonionic dispersibility aids which will decrease the overall softening performance of the compositions.

Also, quaternary compounds having only a single long allyl chain, can protect the cationic softener from interacting with anionic surfactants and/or detergent builders that are carried over into the rinse from the wash solution.

(2) Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl) dodecyl-amine oxide, dimethyldodecylamine oxide, dipropyl-tetradecylamine oxide, methylethylhexadecylamine oxide, dimethyl-2-hydroxyoctadecylamine oxide, and coconut fatty alkyl dimethylamine oxide.

Other nonionic surfactant dispersing aids useful in the present invention are disclosed in the copending application of Cristina Avila-Garcia, et al., Ser. No. 60,007,224, filed Nov. 3, 1995, for "Stable High Perfume, Low-Active Fabric Softener Compositions", said application being incorporated herein by reference.

F. OTHER OPTIONAL INGREDIENTS (A) Brighteners

The premix, and especially the finished compositions herein can also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

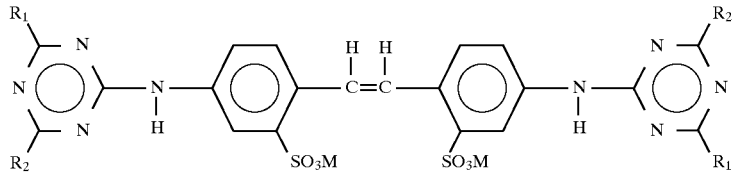

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl) amino]-2,2'-stilbenedisulfonic acid disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methlamino)-s-triazine-2-yl) amino]2,2'-stilbenedisulfonic acid disodium salt. This particular brightener species is commercially marketed under the tradename Tinopal AMS-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl) amino]2,2'-stilbenedisulfonic acid, sodium salt. This particular brightener species is commercially marketed under the tradename Tinopal AMS-GX by Ciba Geigy Corporation.

(B) Stabilizers

Stabilizers can be present in the premixes and finished compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents, in the final composition. For the premix, the levels are adjusted, depending on the concentrations of the softener active in the premix and the finished composition. These assure good odor stability under long term storage conditions. Antioxidants and reductive agent stabilizers are especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox®) 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

(C) Soil Release Agent

In the present invention, an optional soil release agent can be added. The addition of the soil release agent can occur in combination with the premix, in combination with the acid/water seat, before or after electrolyte addition, or after the final composition is made. The finished softening composition prepared by the process of the present invention herein can contain from 0% to about 10%, preferably from 0.2% to about 5%, of a soil release agent. The concentration in the premix is adjusted to provide the desired end concentration. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

Highly preferred soil release agents are polymers of the generic formula:

$$X-(OCH_2CH_2)_p(O-\overset{\overset{\displaystyle O}{\|}}{C}-R^{14}-\overset{\overset{\displaystyle O}{\|}}{C}-OR^{15})_u(O-\overset{\overset{\displaystyle O}{\|}}{C}-R^{14}-\overset{\overset{\displaystyle O}{\|}}{O}C-O)(CH_2CH_2O-)_n-X$$

in which each X can be a suitable capping group, with each X typically being selected from the group consisting of H, and alkyl or acyl groups containing from about 1 to about 4 carbon atoms, p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof. Inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener compositions. Preferably, from about 75% to about 100%, are 1,2-propylene moieties.

The value for each p is at least about 6, and preferably is at least about 10.

The value for each n usually ranges from about 12 to about 113. Typically the value for each p is in the range of from about 12 to about 43.

A more complete disclosure of soil release agents is contained in U.S. Pat. Nos.: 4,661,267, Decker, Konig, Straathof, and Gosselink, issued Apr. 28, 1987; 4,711,730, Gosselink and Diehl, issued Dec. 8, 1987; 4,749,596, Evans, Huntington, Stewart, Wolf, and Zimmerer, issued Jun. 7, 1988; 4,818,569, Trinh, Gosselink, and Rattinger, issued Apr. 4, 1989; 4,877,896, Maldonado, Trinh, and Gosselink, issued Oct. 31, 1989; 4,956,447, Gosselink et al., issues Sept. 11, 1990; and 4,976,879, Maldonado, Trinh, and Gosselink, issued Dec. 11, 1990, all of said patents being incorporated herein by reference.

These soil release agents can also act as scum dispersants.

(D) Scum Dispersant

In the present invention, the premix can be combined with an optional scum dispersant, other than the soil release agent, and heated to a temperature at or above the melting point(s) of the components.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®, Genapol T-800®; Plurafac A-79®; and Neodol 25–50®.

(E) Bactericides

Examples of bactericides which can be present in the premixes and finished compositions of this invention include glutaraldehyde, formaldehyde, 2-bromo-2-nitropropane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon CG/ICP®. Typical levels of bactericides used in the present compositions are from about 1 to about 1,000 ppm by weight of the agent.

(F) Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions are improved.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate), is the material described in U.S. Pat. No. 4,704,233, cited hereinabove, and has the formula (shown in free acid form):

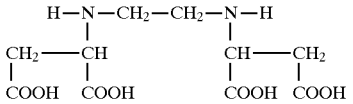

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. At certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein. Preferred chelators include DETMP, DETPA, NTA, EDDS and mixtures thereof.

(G) Optional Viscosity/Dispersibility Modifiers

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in P&G Copending application Ser. No. 08/461,207, filed Jun. 5, 1995, Wahl et al., specifically on page 14, line 12 to page 20, line 12, which is herein incorporated by reference. Fatty acids containing from about 12 to about 18 carbon atoms, especially from about 16 to about 18 carbon atoms, are desirable additives for this purpose, since they can provide additional softening.

(H) Other Optional Ingredients

The present invention can include optional components conventionally used in textile treatment compositions, for example: colorants; preservatives; surfactants; anti-shrinkage agents; fabric crisping agents; spotting agents; germicides; fungicides; anti-corrosion agents; and the like.

The present invention can also include other compatible ingredients, including those as disclosed in copending applications Ser. Nos.: 08/372,068, filed Jan. 12, 1995, Rusche, et al.; 08/372,490, filed Jan. 12, 1995, Shaw, et al.; and 08/277,558, filed Jul. 19, 1994, Hartman, et al., incorporated herein by reference.

PROCESSING ASPECTS

The premixes comprise the softener active A. (from about 50% to about 85%, preferably from about 60% to about 80%, more preferably from about 65% to about 75%, by weight of the premix); the perfume B. (up to about 50% for the high perfume, low active compositions described hereinafter, and less than about 25%, preferably from about 0.5% to about 15%, more preferably from about 1% to about 10% by weight of the premix, for more normal, high softener concentration compositions); optionally, the low molecular weight alcohol C. (from about 5% to about 20%, preferably from about 5% to about 17%, more preferably from about 5% to about 15%, by weight of the premix); optionally the water soluble organic solvent system D. (from about 10% to about 30%, preferably from about 13% to about 25%, more preferably from about 15% to about 20%, by weight of the premix); and optionally, the dispersibility aid E. (from about 2% to about 35%, preferably from about 3% to about 25%, and more preferably from about 4% up to about 15%, by weight of the premix). The perfume B. is usually sufficient to provide the desired viscosity, but, in any event, reduces the level of solvent C. required to achieve the desired viscosities.

These premixes contain the desired amount of fabric softening active A.; perfume B. (an effective amount, but less than about 25%, preferably less than about 15%, and more preferably less than about 10%), and, optionally, low molecular weight alcohol C.; and also, optionally water soluble organic solvent D., to give the premix the desired viscosity for the desired temperature range. Typical viscosities suitable for processing are less than about 1000 cps, preferably less than about 500 cps, more preferably less than about 300 cps. The finished compositions can be made by adding a preheated softener premix to a preheated water seat, but are preferably made at ambient temperatures. Use of low temperatures improves safety, by minimizing solvent vaporization, minimizes the degradation and/or loss of materials such as the biodegradable fabric softener active, perfumes, preservatives, etc., and reduces the need for heating, thus saving on the expenses for processing. The result is improved environmental impact and safety from the manufacturing operation.

Examples of premixes and processes using them include premixes which typically contain from about 55% to about 85%, preferably from about 60% to about 80%, more preferably from about 65% to about 75%, of fabric softener active A., as exemplified in the Examples hereinafter, mixed with 0.5% to about 25% perfume B., and from about 5% to about 20%, preferably from about 5% to about 15%, of water soluble solvent C. like ethanol and/or isopropanol.

Some preferred fabric softener compositions that can be prepared using the premixes herein comprise:

A. from about 15% to about 50%, preferably from about 16% to about 35%, more preferably from about 17% to about 30%, by weight of the composition, of biodegradable fabric softener active selected from the group consisting of:

1. softener having the formula:

$$[(R)_{4-m}—N^{(+)}—[(CH_2)_n—Y—R^1]_m]X^{(-)} \quad (1)$$

wherein each R substituent is a short chain $C_1$–$C_6$, preferably $C_{1-C3}$ alkyl or hydroxyalkyl group, e.g., methyl (most preferred), ethyl, propyl, hydroxyethyl, and the like, benzyl, or mixtures thereof; each m is 2 or 3; each n is from 1 to about 4; each Y is —O—(O)C—, or —C(O)—O—; the sum of carbons in each $R^1$, plus one when Y is —O—(O)C—, is $C_{12}$–$C_{22}$, preferably $C_{14}$–$C_{20}$, with each $R^1$ being a hydrocarbyl, or substituted hydrocarbyl group, preferably, alkyl, monounsaturated alkylene, and polyunsaturated alkylene groups, with the softener active containing polyunsaturated alkylene groups being at least about 3%, preferably at least about 5%, more preferably at least about 10%, and even more preferably at least about 15%, by weight of the total softener active present (As used herein, the "percent of softener active" containing a given $R^1$ group is based upon taking a percentage of the total active based upon the percentage that the given $R^1$ group is, of the total $R^1$ groups present.); the actives preferably containing mixtures of $R^1$ groups, especially within the individual molecules, and also, optionally, but preferably, the saturated $R^1$ groups comprising branched chains, e.g., from isostearic acid, for at least part of the saturated $R^1$ groups, the total of active represented by the branched chain groups preferably being from about 1% to about 90%, preferably from about 10% to about 70%, more preferably from about 20% to about 50% (As used herein, the Iodine Value of a "parent" fatty acid, or "corresponding" fatty acid, is used to define a level of unsaturation for an $R^1$ group that is the same as the level of unsaturation that would be present in a fatty acid containing the same $R^1$ group.); and wherein the counterion, $X^-$, can be any softener-compatible anion, preferably, chloride, bromide, or nitrate, more preferably chloride;

2. softener having the formula:

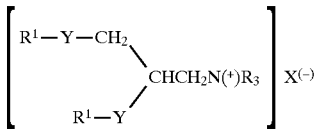

(2)

wherein each Y, R, $R^1$, and $X^{(-)}$ have the same meanings as before (Such compounds include those having the formula:

$$[CH_3]_3\ N^{(+)}[CH_2CH(CH_2OC[O]R^1)OC(O)R^1]Cl^{(-)}$$

especially where $C(O)R^1$ is derived from mixtures of $R^1$ groups, containing some saturated, some unsaturated, e.g., oleic, fatty acid, and some polyunsaturated fatty acid, with some, optionally, but preferably, branched chain $R^1$ groups like isostearyl fatty acid, and, preferably, each R is a methyl or ethyl group and preferably each $R^1$ is in the range of $C_{15}$ to $C_{19}$ with degrees of branching and unsaturation being present in the alkyl chains); and 3. mixtures thereof; said fabric softener active being in the form of a stable dispersion; and B. the balance water and, optionally, from about 5% to about 30%, preferably from about 8% to about 25%, more preferably from about 10% to about 20%, by weight of the composition of water soluble organic solvent; the viscosity of the composition being less than about 500 cps, preferably less than about 400 cps, more preferably less than about 200 cps, and recovering to less than about 1000 cps, preferably less than about 500 cps, more preferably less than about 200 cps after freezing and thawing.

Particularly preferred optional ingredients for use in the compositions of this type, include water soluble, ionizable, calcium and/or magnesium salts, which provide desired viscosity and/or additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1% to about 0.25%. Sodium salts such as NaCl can also be used, especially for compositions containing low levels of softener actives. These materials are desirably in the water and/or acid (water seat) used to prepare the finished compositions. The pH of the finished compositions should be from about 1 to about 7, preferably from about 1.5 to about 5, more preferably from about 2 to about 3.5. The pH is normally adjusted by using a low molecular weight acid, preferably mineral acid, more preferably HCl. Other acids, including nitric acid, acetic acid, etc., can be used to provide the pH.

Other compositions that can be prepared using the premixes herein include the "clear" compositions described in the copending applications, all entitled "Concentrated, Stable, Preferably Clear, Fabric Softening Composition" filed concurrently herewith having Ser. Nos. 08/621,019, 08/620,627, 08/620,767, 08/620,513, 08/621,285, 08/621,299, 08/621,298, 08/620,626, 08/620,625, 08/620,772, 08/621,281, 08/620,514, 08/620,958, and 08/620,782; all of the above cases being filed Mar. 22, 1996, said applications being incorporated herein by reference.

Other low softener, high perfume, compositions, disclosed in the copending application of Cristina Avila-Garcia, et al., Ser. No. 60,07,224, filed Nov. 3, 1995, for "Stable High Perfume, Low-Active Fabric Softener Compositions", said application being incorporated hereinbefore by reference, can be prepared using the premixes including: single strength liquid fabric softener compositions for use in the rinse cycle of a laundering process, the compositions comprising:

(a) from about 0.4% to about 5% cationic fabric softener;

(b) from about 0.3% to about 1.2% hydrophobic perfume;

(c) from about 0.4% to about 5% nonionic surfactant dispersibility aid;

(d) from 0% to about 1% water-soluble ionizable inorganic salt;

(e) from about 90% to about 98.5% water; and (f) from 0% to about 2% other ingredients;

the ratio of cationic softener to perfume being from about 1:3 to about 5:1; the ratio of cationic softener to nonionic surfactant being from about 1:2 to about 4:1, and the amount of cationic softener plus nonionic surfactant being from about 1% to about 7%. The compositions consist of a liquid aqueous phase with discrete hydrophobic particles dispersed substantially uniformly therein. The compositions preferably have a viscosity of from about 50 cp to about 500 cp.

The premixes can be used to formulate finished compositions in simple processes, at ambient temperatures, comprising the steps of:

1. Mix fabric softening active, e.g., about 72% DEQA[1] containing about 11% ethanol, and the perfume, e.g., about 5%, to make the premix.
2. Make up water seat of water and HCl at ambient temperature. Optionally add chelant.
3. Add premix to water under good agitation.
4. Trim with $CaCl_2$ solution to desired viscosity.
5. Add dye solution to get desired colour.

The fabric softening actives (DEQAs); the perfume; and, optionally, the water soluble solvents, can be formulated as premixes as follows.

Premix Examples I–IV

| Component | Example I Wt. % | Example II Wt. % | Example III Wt. % | Example IV Wt. % |
|---|---|---|---|---|
| DEQA[1] (100% active) | 76.5 | 80.75 | — | — |
| DEQA[5] (100% active) | — | — | 76.5 | 80.75 |
| Perfume | 10 | 5 | 10 | 5 |
| Ethanol | 13.5 | 14.25 | 13.5 | 14.25 |
| Total | 100 | 100 | 100 | 100 |
| Approx. Viscosity (cps) | 310 | 275 | 400 | 345 |

The above premixes can be used to formulate finished compositions using the process above, the compositions having the following formulas.

Finished Softener Dispersion Compositions 1–4

| Component | Comp. 1 Wt. % | Comp. 2 Wt. % | Comp. 3 Wt. % | Comp. 4 Wt. % |
|---|---|---|---|---|
| Premix of Example I | 13.07 | — | 6.54 | — |
| Premix of Example II | — | 12.38 | — | 6.19 |
| (DEQA[1] (100% active) | 10 | 10 | 5 | 5) |
| Perfume | 1.31 | 0.62 | 0.65 | 0.31) |
| Ethanol | 1.76 | 1.76 | 0.88 | 0.88) |
| HCl (25% solution) | 0.02 | 0.02 | 0.02 | 0.02 |
| $CaCl_2$ | 0.25 | 0.25 | 1000 ppm | 720 ppm |
| DI Water | Bal. | Bal. | Bal. | Bal. |
| Total | 100 | 100 | 100 | 100 |
| Approx. Viscosity (cps) | 25 | 15 | 15 | 18 |
| Approx. pH | 3.0 | 3.0 | 3.1 | 3.0 |

Finished Softener Dispersion Compositions 5–8

| Component | Comp. 5 Wt. % | Comp. 6 Wt. % | Comp. 7 Wt. % | Comp. 8 Wt. % |
|---|---|---|---|---|
| Premix of Example III | 13.07 | — | 6.54 | — |
| Premix of Example IV | — | 12.38 | — | 6.19 |
| (DEQA[5] (100% active) | 10 | 10 | 5 | 5) |
| (Perfume | 1.31 | 0.62 | 0.65 | 0.31) |
| (Ethanol | 1.76 | 1.76 | 0.88 | 0.88) |
| HCl (25% solution) | 0.02 | 0.02 | 0.02 | 0.02 |
| $CaCl_2$ | 0.25 | 0.25 | 1000 ppm | 720 ppm |
| DI Water | Bal. | Bal. | Bal. | Bal. |
| Total | 100 | 100 | 100 | 100 |
| Approx. Viscosity (cps) | 18 | 15 | 13 | 10 |
| Approx. pH | 3.1 | 3.2 | 3.3 | 3.1 |

Premix Examples V–VIII

| Component | Example V Wt. % | Example VI Wt. % | Example VII Wt. % | Example VIII Wt. % |
|---|---|---|---|---|
| DEQA[1] (100% active) | 48.2 | 49.8 | — | — |
| DEQA[5] (100% active) | — | — | 48.2 | 49.8 |
| Perfume | 6.3 | 3.1 | 6.3 | 3.1 |
| Ethanol | 12.2 | 12.6 | 12.2 | 12.6 |

-continued

Premix Examples V–VIII

| Component | Example V Wt. % | Example VI Wt. % | Example VII Wt. % | Example VIII Wt. % |
|---|---|---|---|---|
| 1,2-Hexanediol | 33.3 | 34.5 | 33.3 | 34.5 |
| Total | 100 | 100 | 100 | 100 |
| Approx. Viscosity (cps) | — | — | — | — |

The above premixes can be used to formulate clear finished compositions as follows.

Finished Clear Softener Compositions 9–12

| Component | Comp. 9 Wt. % | Comp. 10 Wt. % | Comp. 11 Wt. % | Comp. 12 Wt. % |
|---|---|---|---|---|
| Premix of Example V | 34 | — | — | — |
| Premix of Example VI | — | 32.2 | — | — |
| Premix of Example VII | — | — | 34 | — |
| Premix of Example VIII | — | — | — | 32.2 |
| DEQA[1] (100% active) | 26 | 26 | — | |
| DEQA[5] (100% active) | — | — | 26 | 26 |
| Perfume | 3.4 | 1.6 | 3.4 | 1.6 |
| Ethanol | 6.6 | 6.6 | 6.6 | 6.6 |
| 1,2-Hexanediol | 18 | 18 | 18 | 18 |
| HCl (25% solution) | 0.02 | 0.02 | 0.02 | 0.02 |
| DI Water | Bal. | Bal. | Bal. | Bal. |
| Total | 100 | 100 | 100 | 100 |
| Approx. Viscosity (cps) | 25 | 25 | 23 | 25 |

Premix Examples IX–XI

| Component | Example IX Wt. % | Example X Wt. % | Example XI Wt. % | Example XII Wt. % |
|---|---|---|---|---|
| DEQA[10] (100% active) | 54.9 | — | — | — |
| DEQA[11] (100% active) | 25.9 | — | — | — |
| DEQA[12] (100% active) | — | 80.75 | — | — |
| DEQA[1] | — | — | 52.5 | — |
| DEQA[5] | — | — | — | 52.5 |
| DEQA[13] | — | — | 28.3 | 28.3 |
| Perfume | 5 | 5 | 5 | 5 |
| Ethanol | 14.25 | 14.25 | 14.25 | 14.25 |
| Total | 100 | 100 | 100 | 100 |

DEQA[10] N,N-di(tallowoyloxyethyl)-N,N-dimethyl ammonium chloride.
DEQA[11] di(partially hydrogenated soyaoyloxyethyl)-N,N-dimethyl ammonium chloride.
DEQA[12] N,N-di(acyloxyethyl)-N,N-dimethyl ammonium chloride, wherein the acyl group is derived from a mixture of tallow and partially hydrogenated soya fatty acids at an approximate 68:32 weight ratio.
DEQA[13] N,N-di(isosteroyloxyethyl)-N,N-dimethyl ammonium chloride.

What is claimed is:

1. A fabric softener premix composition, said premix composition having a viscosity of less than about 1000 cps at ambient temperature, said composition being useful for preparing finished compositions, and consisting essentially of:

A. from about 60% to about 85% of fabric softener active selected from the group consisting of:

1. fabric softener compound having the formula:

$$[(R)_{4-m}—N^{(+)}—[(CH_2)_n—Y—R^1]_m]X^{(-)} \quad (1)$$

wherein each R substituent is a shot chain $C_1$–$C_6$ alkyl or hydroxyalkyl group, benzyl, or mixtures thereof; each m is 2 or 3; each n is from 1 to about 4; each Y is —O—(O)C—, or —C(O)—; the sum of carbons in each $R^1$, plus one when Y is —O—(O)C—, is $C_{12}$–$C_{22}$ with $R^1$ being hydrocarbyl, or substituted hydrocarbyl, stibstituent; and the iodine Value of a fatty acid which contains this $R^1$ group is from about 60 to about 140, and wherein said softener active can comprise up to about 20% of inonoester compound in which m is 2 and one $YR^1$ is H or —C(O)OH;

2. fabric softener compound having the formula:

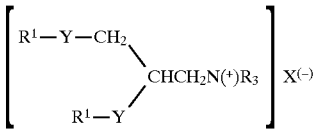

(2)

wherein each Y, R, $R^1$, and $X^{(-)}$ have the same meanings as before and wherein said softener active can comprise up to about 20% of monoester compound in which one $YR^1$ is 11 or —C(O)OH; and 3. mixtures thereof;

B. an effective amount to provide perfume effects in the finished composition and to improve processability of the premix compositions, but less than about 25%, of perfume, said perfume being added to said fabric softener compound prior to the addition of water and acid;

C. optionally, an effective amount; sufficient to lower the viscosity, of low molecular weight water soluble solvents;

D. optionally, less than about 40% by weight of the premix composition of water soluble organic solvent having a boiling point above about 85° C., to lower the viscosity; and E. optionally, an effective amount, sufficient to disperse the perfume and/or the softener active of a dispersibility aid.

2. The fabric softener premix composition of claim 1 consisting essentially of:

A. from about 60% to about 80% of said fabric softener active selected from the group consisting of:

1. fabric softener compound having the formula:

$$[(R)_{4-m}—N^{(+)}—[(CH_2)_n—Y—R^1]_m]X^{(-)} \quad (1)$$

wherein each R substituent is a short chain $C_{1-C3}$ alkyl or hydroxyalkyl group, benzyl or mixtures thereof; each m is 2; each n is from 2 to about 3; each Y is —O—(O)C—; the sum of carbons in each $R^1$ plus one is $C_{14}$–$C_{20}$; the Iodine Value of the corresponding fatty acid of this $R^1$ group is from about 70 to about 130, and the total level of polyunsaturated acyl groups, comprising $R^1$ is from about 1% to about 30%;

2. fabric softener compound having the formula:

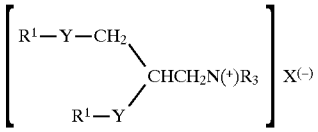

(2)

wherein each Y, R, $R^1$, and $X^{(-)}$ have the same meanings as before; and 3. mixtures thereof;

B. from about 0.5% to about 15% perfume;

C. optionally, from 0% to about 20%, of low molecular weight alcohol selected from the group consisting of: ethanol, isopropanol, n-propanol, and mixtures thereof;

D. optionally, from about 10% to about 30% of said water soluble organic solvent; and E. optionally, from about 2% to about 35% of said dispersing aid.

3. The fabric softener premix composition of claim 2 consisting essentially of:

A. from about 65% to about 75% of said fabric softener active said fabric softener active being:

1. fabric softener compound having the formula:

$$[(R)_{4-m}—N^{(+)}—[(CH_2)_n—Y—R^1]_m]X^{(-)} \quad (1)$$

wherein each R substituent is a short chain $C_1$–$C_3$ alkyl or hydroxyalkyl group, benzyl or mixtures thereof; each m is 2; each n is from 2 to about 3; for each $R^1$ the Iodine Value of the corresponding fatty acid is from about 80 to about 115, and the total level of polyunsaturated acyl groups comprising $R^1$ is from about 1% to about 25%;

B. from about 1% to about 10% perfume;

C. optionally, from about 5% to 15%, and sufficient to improve viscosity, of said low molecular weight alcohol;

D. optionally, from about 12% to about 25% of said water soluble organic solvent; and E. optionally, from about 3% to about 25% of said dispersing aid.

4. The fabric softener premix composition of claim 3 consisting essentially of:

A. from about 65% to about 75% by weight of the premix composition, of said fabric softener wherein each n is 2; each $R^1$ is a long chain $C_{13}$–$C_{17}$ straight chain alkyl or alkylene, the total level of polyunsaturated acyl groups, comprising $R^1$ is from about 5% to about 18%, and the cis/trans ratio is from about 1:1 to about 50:1;

B. from about 1% to about 5% by weight of the premix composition of said perfume;

C. optionally, from about 5% to 15%, and sufficient to improve viscosity, of said low molecular weight alcohol;

D. optionally, from about 13% to about 20% of said water soluble organic solvent; and E. optionally, from about 4% to about 15% of said dispersing aid.

5. The fabric softener premix composition of claim 1 wherein the softener active contains up to about 20% of monoester compound wherein m is 2, and $YR^1$ is either H or —C(O)OH.

6. The process of making a finished fabric softening composition by adding a fabric softener premix composition, said premix composition having a viscosity of less than about 1000 cps at ambient temperature, and consisting essentially of:

A. from about 60% to about 85% or fabric softener active selected from the group consisting of:

1. fabric softener compound having the formula:

$$[(R)_{4-m}—N^{(+)}—[(CH_2)_n—Y—R^1]_m]X^{(-)} \quad (1)$$

wherein each R substituent is a short chain $C_1$–$C_6$ alkyl or hydroxyalkyl group, benzyl, or mixtures thereof; each m is 2 or 3; each n is from 1 to about 4; each Y is —O—(O)C—, or —C(O)—O—; the sum of carbons in each $R^1$, plus one when Y is —O—(O)C—, is $C_{12}$–$C_{22}$, with $R^1$ being hydrocarbyl, or substituted hydrocubyl, substituent; and the Iodine Value of a fatty acid which contains this $R^1$ group is from about 60 to about 140, and wherein said softener active can comprise up to about 20% of monoester compound in which in is 2 and one $YR^1$ is H or —C(O)OH;

2. fabric softener compound having the formula:

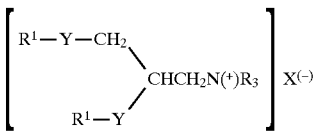

(2)

wherein each Y, R, $R^1$, and $X^{(-)}$ have the same meanings as before and wherein said softener active can comprise up to about 20% of monoester compound in which one $YR^1$ is H or —C(O)OH; and 3. mixtures thereof, B. an effective amount to provide perfume effects in the finished composition and to improve proecssability of the premix compositions, but less than about 25%, of perfume, said perfume being added to said fabric softener compound prior to the addition of water and acid;

C. optionally, an effective amount sufficient to lower the viscosity, of low molecular weight water soluble solvents;

D. optionally, less than about 40% by weight of the premix composition of water soluble organic solvent having a boiling point above about 85° C., to lower the viscosity; and E. optionally, an effective amount, sufficient to disperse the perfume and/or the softener active of a dispersibility aid, to a water seat comprising: water; acid to create a pH of from about 1.5 to about 5; and, optionally, an effective amount of water soluble calcium and/or magnesium salt, and mixing.

7. The process of making a finished fabric softening composition by adding a fabric softener premix composition, said premix composition having a viscosity of less than about 1000 cps at ambient temperature, and consisting essentially of:

A. from about 60% to about 80% of said fabric softener active selected from the group consisting of:

1. fabric softener compound having the formula:

$$[(R)_{4-m}—N^{(+)}—[(CH_2)_n—Y—R^1]_m]X^{(-)} \quad (1)$$

wherein each R substituent is a short chain $C_1$–$C_3$ alkyl or bydroxyalkyl group, benzyl or mixtures thereof; each m is 2; each n is from 2 to about 3; each Y is —O—(O)C—; the sum of carbons in each $R^1$ plus one is $C_{14}$–$C_{20}$; the Iodine Value of the corresponding fatty acid of this $R^1$ group is from about 70 to about 130, and the total level of polyunsaturated acyl groups, comprising $R^1$ is from about 1% to about 30%;

2. fabric softener compound having the formula:

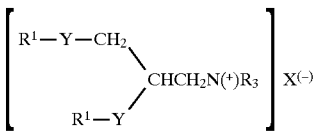

(2)

wherein each Y, R, $R^1$, an d $X^{(-)}$ have the same meanings as before and 3. mixtures thereof, B. from about 0.5% to about 15% perfume, said perfume being added to said fabric softener compound prior to the addition of water and acid;

C. optionally, from 0% to about 20%, of low molecular weight alcohol selected from the group consisting of: ethanol, isopropanol, n-propanol, and mixtures thereof;

D. optionally, from about 10% to about 30% of said water soluble organic solvent; and E. optionally, from about 2% to about 35% of said dispersing aid;

to a water seat comprising water; acid to create a pH of from about 1.5 to about 5; and, optionally, an effective amount of water soluble calcium and/or magnesium salt, and mixing.

8. The process of making a finished fabric softening composition by adding a fabric softener premix composition, said premix composition having a viscosity of less than about 1000 cps at ambient temperature, and consisting essentially of:

A. from about 65% to about 75% of said fabric softener active said fabric softener active being:

1. fabric softener compound having the formula:

$$[(R)_{4-m}—N^{(+)}—[(CH_2)_n—Y—R^1]_m]X^{(-)} \quad (1)$$

wherein each R substituent is a short chain $C_1$–$C_3$ alkyl or hydroxyalkyl group, benzyl or mixtures thereof, each m is 2; each n is from 2 to about 3; for each $R^1$ the Iodine Value of the corresponding fatty acid is from about 80 to about 115, and the total level of polyunsaturated acyl groups comprising $R^1$ is From about 1% to about 25%;

B. from about 1% to about 10% perfume, said perfume being added to said fabric softener compound prior to the addition of water and acid;

C. optionally from about 5% to 15%, and sufficient to improve viscosity, of said low molecular weight alcohol;

D. optionally, from about 12% to about 25% of said water soluble organic solvent; and E. optionally, from about 3% to about 25% of said dispersing aid;

to a water seat comprising water; acid to create a pH of from about 1.5 to about 5; and, optionally, an effective amount of water soluble calcium and/or magnesium salt, and mixing.

9. The process according to claim 6 wherein said fabric softener premix consists essentially of:

A. from about 65% to about 75% by weight of the premix composition, of said fabric softener wherein each 1 is 2; each $R^1$ is a long chain $C_{13}$–$C_{17}$ straight chain alkyl or alkylone, the total level of polyunsaturated acyl groups, comprising $R^1$ is from about 5% to about 18%, and the cis/trans ratio is from about 1:1 to about 50:1;

B. from about 1% to about 5% by weight of the premix composition of said perfume;

C. optionally, from about 5% to 15%, and sufficient to improve viscosity, of said low molecular weight alcohol;

D. optionally, from about 13% to about 20% of said water soluble organic solvent; and E. optionally, from about 4% to about 15% of said dispersing aid.

* * * * *